US009599395B2

(12) United States Patent
Yamashita et al.

(10) Patent No.: US 9,599,395 B2
(45) Date of Patent: Mar. 21, 2017

(54) REFRIGERATING APPARATUS

(75) Inventors: Tetsuya Yamashita, Tokyo (JP); Takeshi Sugimoto, Tokyo (JP); Takashi Ikeda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 404 days.

(21) Appl. No.: 13/876,570

(22) PCT Filed: Nov. 14, 2011

(86) PCT No.: PCT/JP2011/006332

§ 371 (c)(1),
(2), (4) Date: Mar. 28, 2013

(87) PCT Pub. No.: WO2012/066763

PCT Pub. Date: May 24, 2012

(65) Prior Publication Data

US 2013/0180278 A1 Jul. 18, 2013

(30) Foreign Application Priority Data

Nov. 15, 2010 (JP) ..... 2010-254568

(51) Int. Cl.

| | |
|---|---|
| ***F25B 7/00*** | (2006.01) |
| ***F25B 9/00*** | (2006.01) |
| ***F25B 49/02*** | (2006.01) |
| ***F25D 31/00*** | (2006.01) |
| ***F25B 6/04*** | (2006.01) |

(52) U.S. Cl.

CPC ..... *F25D 31/00* (2013.01); *F25B 6/04* (2013.01); *F25B 7/00* (2013.01); *F25B 9/008* (2013.01); *F25B 49/02* (2013.01)

(58) Field of Classification Search

CPC ..... F25B 7/00
USPC ..... 62/175, 335, 196.3
See application file for complete search history.

(56) References Cited

U.S. PATENT DOCUMENTS 5,044,172 A * 9/1991 Inoue et al. ..... 62/335
5,740,679 A 4/1998 Ueno et al.

FOREIGN PATENT DOCUMENTS

| | | |
|---|---|---|
| CN | 1146807 A | 4/1997 |
| JP | 60-38561 A | 2/1985 |
| JP | 61-006551 A | 1/1986 |
| JP | H05-005567 A | 1/1993 |

(Continued)

OTHER PUBLICATIONS

Office Action mailed Sep. 19, 2014 issued in corresponding CN patent application No. 201180054852.3 (and English translation).

(Continued)

*Primary Examiner* — Judy Swann
*Assistant Examiner* — Zachary R Anderegg
(74) *Attorney, Agent, or Firm* — Posz Law Group, PLC

(57) ABSTRACT

A refrigerating apparatus includes a high temperature side first cycle; a high temperature side second cycle; a low temperature side cycle in which carbon dioxide is used as a refrigerant; a first cascade condenser and a second cascade condenser, which each exchange heat between a high temperature side refrigerant and a low temperature side refrigerant; and a control unit lowering an evaporation temperature of a high temperature side evaporator in correspondence to the flow of the low temperature side refrigerant.

11 Claims, 3 Drawing Sheets

(56) References Cited

FOREIGN PATENT DOCUMENTS

| | | | |
|---|---|---|---|
| JP | 08-189713 | A | 7/1996 |
| JP | 2000-227261 | A | 8/2000 |
| JP | 2001-091074 | A | 4/2001 |
| JP | 3604973 | B2 | 12/2004 |
| JP | 2005-180866 | A | 7/2005 |
| JP | 2009-014271 | A | 1/2009 |
| JP | 2009-030001 | A | 2/2009 |
| JP | 2009-040407 | A | 2/2009 |
| JP | 2009-298927 | A | 12/2009 |
| JP | 2009-300001 | A | 12/2009 |
| JP | 2010-78309 | A | 4/2010 |
| JP | 2010-096442 | A | 4/2010 |
| JP | 2010-127600 | A | 6/2010 |
| JP | 2010-196950 | A | 9/2010 |
| JP | 2010-196952 | A | 9/2010 |

OTHER PUBLICATIONS

Office Action mailed Oct. 7, 2014 issued in corresponding JP patent application No. 2012-544106 (and English translation).
Office Action mailed Feb. 18, 2014 issued in corresponding JP patent application No. 2012-544106 (and English translation).
International Search Report of the International Searching Authority mailed Jan. 10, 2012 for the corresponding international application No. PCT/JP2011/006332 (with English translation).
Office Action mailed Jun. 23, 2015 in the corresponding JP application No. 2012-544106. ( English translation attached ).
Office Action issued Feb. 2, 2016 in the corresponding JP application No. 2012-544106 (with English translation).

* cited by examiner

REFRIGERATING APPARATUS

CROSS REFERENCE TO RELATED APPLICATIONS

This application is a U.S. national stage application of PCT/JP2011/006332 filed on Nov. 14, 2011, and claims priority to, and incorporates by reference, Japanese Patent Application No. 2010-254568 filed on Nov. 15, 2010.

TECHNICAL FIELD

The present invention relates to a refrigerating apparatus which can be used in domestic and industrial refrigerator-freezers, ultra-deep freezers, refrigerator-freezer show case cooling systems and the like. In particular, the present invention relates to a multidimensional refrigerating apparatus in which plural refrigeration cycle units (refrigerant circulation circuits) are configured in a multi-stage manner.

BACKGROUND ART

Conventionally, there have existed refrigerating apparatuses each having, for example, a refrigeration cycle unit provided at a high temperature side (upper stage side, primary side) (hereinafter referred to as a high temperature side cycle), and a refrigeration cycle unit provided at a low temperature side (lower stage side, secondary side) (hereinafter referred to as a low temperature side cycle), the refrigeration cycles being configured in a multi-stage manner (here, a cascade refrigerating apparatus having a two-stage structure is referred to). In such refrigerating apparatuses as described above, by exchanging heat with an object to be cooled, or the like in an evaporator of the low temperature side cycle which becomes a final stage while, for example, exchanging heat between condensation heat generated by condensation of a refrigerant in the low temperature side cycle and evaporation heat generated by evaporation of a refrigerant in the high temperature side cycle, a coordinated refrigerating operation is performed. As a result, in the evaporator of the low temperature side cycle, evaporation heat at a low temperature, that is, at several tens of degree of temperature below the freezing point can be obtained with high efficiency.

Some of such cascade refrigerating apparatuses as described above exist in which a hydrocarbon-based refrigerant having a low global warming potential (GWP) is used as a refrigerant to circulate in the high temperature side cycle, and carbon dioxide is used as a refrigerant to circulate in the low temperature side cycle from the standpoint of preventing global warming (for example, refer to patent literature 1).

CITATION LIST

Patent Literature

Patent Literature 1: Japanese Patent No. 3604973 (page 4, FIG. 1)

SUMMARY OF THE INVENTION

Technical Problem

Here, a case in which, for example, a refrigerating apparatus becomes larger in size will be described. When a refrigerating apparatus becomes larger, the amount of refrigerant charged also increases. In the cascade refrigerating apparatus as described above, a hydrocarbon-based refrigerant used in the high temperature side cycle is combustible, and therefore, if the amount of refrigerant charged is large, a considerable cost for equipment or the like required for safety measures on the assumption that leakage of a refrigerant or the like may occur must be entailed. For example, the same also applies to a refrigerant having combustion characteristics, for example, tetrafluoropropene such as 2,3,3,3-tetrafluoropropene (HFO-1234yf), or R32.

Further, in a case in which, for example, a chlorofluorocarbon refrigerant (R410A or the like), which is incombustible but has a relatively low GWP, is used in the high temperature refrigeration cycle, a considerable cost must become necessary for equipment or the like for performing environmental protection against leakage of refrigerant or the like, from the standpoint of refrigerant leakage management for environmental protection. Moreover, for the environmental protection measures, desirably, not only the GWP of the refrigerant, but also total equivalent warming impact (TEWI) are reduced with the operating efficiency of the cascade refrigerating apparatus being enhanced, and a contribution to prevention of global warming also should be considered.

The present invention has been achieved to solve the above-described problems, and an object thereof is to provide a cascade refrigerating apparatus which enables achievement in cost reduction of a multidimensional refrigerating apparatus, promotion of the operating efficiency of the apparatus, and focus on environmental concerns.

Solution to Problems

A refrigerating apparatus comprises: a plurality of high temperature side cycle units each forming a high temperature side circulation circuit in which a high temperature side compressor, a high temperature side condenser, a high temperature side expansion unit and a high temperature side evaporator are connected by pipes to circulate a high temperature side refrigerant; a low temperature side cycle unit forming a low temperature side circulation circuit in which a low temperature side compressor, a plurality of low temperature side condensers, a low temperature side expansion unit and a low temperature side evaporator are connected by pipes to circulate carbon dioxide as a low temperature side refrigerant; and a plurality of cascade condensers formed by the respective high temperature side evaporators of the plurality of high temperature side cycle units, and the respective low temperature side condensers, and each exchanging heat between the high temperature side refrigerant and the low temperature side refrigerant. The above-described apparatus further comprises a control unit controlling so as to sequentially lower evaporation temperatures in the high temperature side evaporators in correspondence to the order that the low temperature side refrigerant flows in and out from the low temperature side condensers.

Advantageous Effects of Invention

According to the refrigerating apparatus of the present invention, the low temperature side refrigerant circulating in the low temperature side cycle is condensed and liquefied using plural high temperature side cycle units, so as to reduce the amount of high temperature side refrigerant circulating in each of the high temperature cycle units. Therefore, even when a refrigerant having combustion characteristics such as hydrocarbon-based refrigerant, HFO1234yf, R32, or a refrigerant having a high GWP is used, the amount of refrigerant during one refrigeration cycle can be reduced, and costs required for safety measures and environmental protection in which the unlikely event that a refrigerant may leak out from the refrigeration cycle is assumed, also can be reduced. In this case, the evaporation temperature in the high temperature side evaporator is adapted to be lowered along the direction in which the low temperature side refrigerant flows, and therefore, the low temperature side refrigerant can be gradually cooled and also can be evaporated and liquefied with high efficiency, whereby energy saving can be achieved. As a result, the value of TEWI can be reduced and making a contribution to prevention of global warming can be achieved coincidentally.

DESCRIPTION OF EMBODIMENTS

Embodiments of the present invention are described hereinafter on the basis of the attached drawings.

Figure 1:
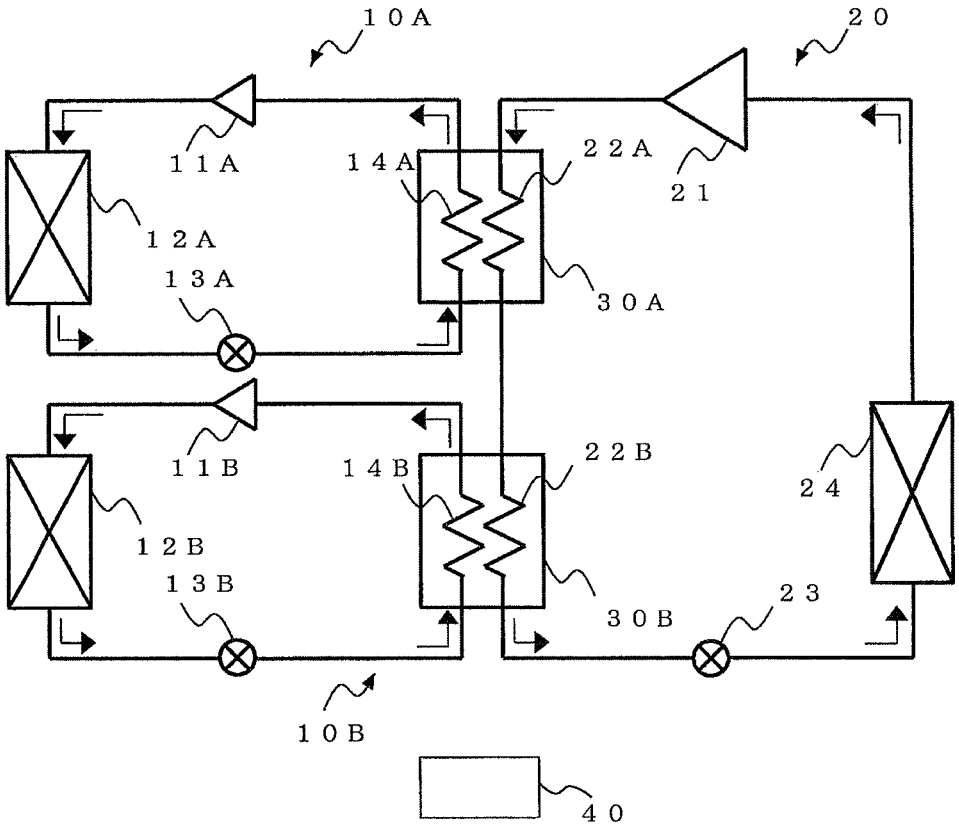
FIG. 1 is a diagram showing a structure of a refrigerating apparatus in Embodiment 1 of the present invention.

Embodiment 1:

FIG. 1 is a diagram showing the structure of a refrigerating apparatus according to Embodiment 1 of the present invention. As shown in FIG. 1, the refrigerating apparatus of this embodiment is described hereinafter as a cascade refrigerating apparatus. The cascade refrigerating apparatus of this embodiment has a high temperature side first cycle 10A, a high temperature side second cycle 10B and a low temperature side cycle 20, and these cycles independently form refrigerant circulation circuits in which respective refrigerants are circulated. Then, the refrigerant circulation circuits are configured in a multi-stage manner, and therefore, a first cascade condenser (a refrigerant-to-refrigerant heat exchanger) 30A is provided in such a manner to exchange heat between refrigerants passing through a high temperature side first evaporator 14A and a low temperature side first condenser 22A, respectively. Similarly, a second cascade condenser 30B is provided in such a manner to exchange heat between refrigerants passing through a high temperature side second evaporator 14B and a low temperature side second condenser 22B, respectively. Here, rise and drop in temperature, and rise and drop in pressure are each not particularly determined based on the relationships to absolute values, and are relatively fixed in the state of a system, a unit or the like, operations thereof and the like.

In FIG. 1, the high temperature side first cycle 10A forms a refrigerant circulation circuit (hereinafter referred to as a high temperature side first circulation circuit) in such a manner that a high temperature side first compressor 11A, a high temperature side first condenser 12A, a high temperature side first expansion unit 13A and a high temperature side first evaporator 14A are connected in series by use of refrigerant pipes. Further, a high temperature side second cycle 10B forms a refrigerant circulation circuit (hereinafter referred to as a high temperature side second circulation circuit) in such a manner that a high temperature side second compressor 11B, a high temperature side second condenser 12B, a high temperature side second expansion unit 13B, and a high temperature side second evaporator 14B are connected in series by use of refrigerant pipes.

On the other hand, the low temperature side cycle 20 forms a refrigerant circulation circuit (hereinafter referred to as a low temperature side circulation circuit) in such a manner that a low temperature side compressor 21, a low temperature side first condenser 22A, a low temperature side second condenser 22B, a low temperature side expansion unit 23, and a low temperature side evaporator 24 are connected by refrigerant pipes.

In the cascade refrigerating apparatus having the above-described structure, as the refrigerant (hereinafter referred to as a high temperature side refrigerant) circulating in the high temperature side first circulation circuit and also in the high temperature side second circulation circuit, for example, R410A, R32, R404A, HFO-1234yf, propane, isobutane, carbon dioxide, ammonia or the like is used. In the present embodiment, HFO-1234yf (boiling point: −29 degrees C., GWP: 4) is used as a high temperature side refrigerant (hereinafter referred to as a high temperature side first refrigerant) which is used in the high temperature side first cycle 10A (high temperature side first circulation circuit), and R32 (boiling point: −51.7 degrees C., GWP: 675) is used as a high temperature side refrigerant (hereinafter referred to as a high temperature side second refrigerant) which is used in the high temperature side second cycle 10B (high temperature side second circulation circuit). Further, carbon dioxide ($CO_2$, GWP: 1) which exerts a small effect on global warming is used in a refrigerant (hereinafter referred to as a low temperature side refrigerant) which circulates in the low temperature side circulation circuit.

Next, various constituent units of the cascade refrigerating apparatus are described hereinafter further in detail. The high temperature side first compressor 11A of the high temperature side first cycle 10A and the high temperature side second compressor 11B of the high temperature side second cycle 10B each suck in the high temperature side refrigerant, compress and discharge the refrigerant into a high temperature and high pressure state. Here, the above-described compressors each may be formed by, for example, a compressor of such a type as to be capable of controlling the number of rotation by an inverter circuit or the like and adjusting the amount of high temperature side refrigerant discharged therefrom. The high temperature side first condenser 12A and the high temperature side second condenser 12B are each provided so as to exchange heat between air or water supplied from an air sending unit, a pump or the like (not shown), and a high temperature side refrigerant, and condense (condense and liquefy) the high temperature side refrigerant into a liquid-state refrigerant (liquid refrigerant). In this case, the air sending device or the like may also be provided correspondingly to each of the high temperature side first condenser 12A and the high temperature side second condenser 12B, or may be provided in common with these condensers.

The high temperature side first expansion unit 13A and the high temperature side second expansion unit 13B such as a pressure reducing valve, an expansion valve are each used to depressurize and expand the high temperature side refrigerant. For example, the above-described expansion units are each most suitably formed by a flow control unit such as the above-described electronic expansion valve, but may also be formed by a refrigerant flow adjusting unit such as a capillary tube. The high temperature side first evaporator 14A and the high temperature side second evaporator 14B are each used to evaporate (evaporate and gasify) the high temperature refrigerant by use of heat exchange into a gas-like refrigerant (gas refrigerant). In this case, the first cascade condenser 30A and the second cascade condenser 30B each exchange heat with a low temperature side refrigerant.

The low temperature side compressor 21 of the low temperature side cycle 20 sucks in a low temperature side refrigerant and compresses the refrigerant and discharges the same into a high temperature and high pressure state. The low temperature side compressor 21 may also be formed by, for example, a compressor of such a type as to have an inverter circuit or the like and adjust the amount of the low temperature refrigerant discharged.

The low temperature side first condenser 22A and the low temperature side second condenser 22B are each used to condense and liquefy the low temperature side refrigerant by use of heat exchange. In this case, in the first cascade condenser 30A and the second cascade condenser 30B, the heat exchange with a high temperature side refrigerant is carried out. The low temperature side first condenser 22A may cause the low temperature side refrigerant to be condensed, but there are cases that the low temperature side refrigerant may be only cooled down to a predetermined temperature so as to draw heat from the low temperature side refrigerant without condensing and liquefying the low temperature side refrigerant.

The low temperature side expansion unit 23 such as a pressure reducing valve, or an expansion valve is used to depressurize and expand the low temperature side refrigerant. The low temperature side expansion unit is most suitably formed by, for example, a flow control unit such as the above-described electronic expansion valve, but also may be formed by a refrigerant flow adjusting unit such as a capillary tube. Here, it is assumed that the low temperature expansion unit used in the present embodiment is formed by a flow control unit which performs adjustment of the opening degree based on an instruction form the control unit 40. In a case in which, for example, the low temperature side expansion unit 23 is the refrigerant flow adjusting unit, a bypass pipe (not shown) may also be provided in parallel with the low temperature side expansion unit 23 in order to achieve reduction of pressure loss in a case of no need of the refrigerant flow adjusting unit. Then, in a case in which the refrigerant flow adjusting unit is not required, a configuration which enables switching to flow the refrigerant into the bypass pipe may also be provided.

The low temperature side evaporator 24 exchanges heat between a low temperature side refrigerant, and air, brine or the like supplied from an air sending device, a pump or the like (not shown), and evaporates and gasifies the low temperature side refrigerant. Due to the heat exchange with the low temperature side refrigerant, an object to be cooled (an object to be kept cold or to be frozen) would be cooled directly or indirectly.

Further, the first cascade condenser 30A and the second cascade condenser 30B are each comprised of, for example, a plate heat exchanger, a double pipe heat exchanger or the like. The first cascade condenser 30A is structured in such a manner as to connect the high temperature side first evaporator 14A and the low temperature side first condenser 22A to each other, so as to enable to exchange heat between the high temperature side refrigerant and the low temperature side refrigerant. Similarly, the second cascade condenser 30B is structured in such a manner as to connect the high temperature side second evaporator 14B and the low temperature side second condenser 22B to each other, so as to enable to exchange heat between the high temperature side refrigerant and the low temperature side refrigerant. The first cascade condenser 30A and the second cascade condenser 30B form a two-stage structure, so as to exchange heat between the refrigerants, thereby making it possible to control in cooperation with an independent refrigerant circulation circuit. Unless need be particularly distinguished or specified for the units with suffixes added thereto, there are cases that they may be described with the suffixes thereof being left out.

A control unit 40 monitors the states of the high temperature side first cycle 10A, high temperature side second cycle 10B and low temperature side cycle 20, and controls an operation such as a cooling operation in the cascade refrigerating apparatus. In this case, a configuration in which the control unit 40 is used to control the operations of respective units of the high temperature side first cycle 10A, high temperature side second cycle 10B and low temperature side cycle 20 is described, but it may also be formed by plural control units which control the operations of the various units of each of the refrigeration cycle units, respectively.

Next, the operations of various constituent units during the cooling operation of the cascade refrigerating apparatus are described on the basis of the flow of a refrigerant circulating in each of refrigerant circulation circuits. First of all, a description of the operation during the cooling operation of the high temperature side first cycle 10A is given. The high temperature side compressor 11A sucks in a high temperature side refrigerant and compresses and discharges the refrigerant into a high temperature and high pressure state. The discharged refrigerant flows into the high temperature side first condenser 12A. The high temperature side first condenser 12A exchanges heat between a high temperature side refrigerant, and air, water or the like supplied from an air sending device, pump or the like (not shown), and condenses and liquefies the high temperature side refrigerant. The condensed and liquefied high temperature side refrigerant passes through the high temperature side first expansion unit 13A. The high temperature side first expansion unit 13A depressurizes the condensed and liquefied refrigerant passing therethrough. The depressurized refrigerant flows into the high temperature side first evaporator 14A (first cascade condenser 30A). The high temperature side first evaporator 14A evaporates and gasifies the high temperature side refrigerant due to heat exchange with a low temperature side refrigerant. The evaporated and gasified high temperature side refrigerant is sucked in by the high temperature side first compressor 11A. Here, in a case in which the high temperature side first evaporator 13A is, for example, an electronic expansion valve, the control unit 40 causes the high temperature side first expansion unit 13A to perform adjustment of the opening degree thereof so that the high temperature side refrigerant flowing out from the high temperature side first evaporator 14A has a required degree of superheat (4 to 10K). The similar operation is carried out in each of units of the high temperature side second cycle 10B.

In the refrigerating apparatus of the present embodiment, a cooling operation in which a low temperature side refrigerant is condensed and liquefied by a two-step process is carried out, so that the entire apparatus is adapted to perform a highly efficient operation. In this case, the control unit 40 controls such that the evaporation temperature in the high temperature side first evaporator 14A would become higher than the evaporation temperature in the high temperature side second evaporator 14B.

As described above, in the present embodiment, HFO-1234yf (boiling point: −29 degrees C.) is used as a high temperature side refrigerant used in the high temperature side first circulation circuit, and R32 (boiling point: −51.7 degrees C.) is used as a high temperature side refrigerant used in the high temperature side second circulation circuit. Here, the boiling point refers to a typical numeric value which represents the characteristics of a refrigerant. As the boiling point becomes low, the operating efficiency of the refrigeration cycle decreases. This is due to that if the boiling point is low, the critical temperature thereby becomes low and evaporation latent heat of the liquid refrigerant becomes small, which leads to reduction in the refrigerating effect.

Accordingly, in the refrigeration cycle apparatus in which a refrigerant having a high boiling point can be used, energy saving can be achieved by use of a refrigerant whose boiling point is high. Consequently, in the present embodiment, Refrigerant HFO-124yf (boiling point: −29 degrees C.) is filled (charged) as a high temperature side refrigerant of the high temperature side first cycle 10A which is capable of setting the evaporation temperature at a high value. At the present, refrigerant HFO-1234fy is a refrigerant having the highest boiling point among refrigerants whose GWP is 300 or less.

On the other hand, if the evaporation temperature becomes low, in a case of using a refrigerant having a high boiling point, the density of a gas refrigerant sucked in by a compressor decreases, and a refrigerating effect becomes lessened, whereby the apparatus becomes a large-scaled one. Accordingly, the high temperature side second cycle 10B whose the evaporation temperature is set lower than that of the high temperature side first cycle 10A makes it possible to maintain the refrigerating effect even if the boiling point thereof is low, and refrigerant R32 is charged so as to prevent formation of a large-scaled apparatus.

Figure 2:
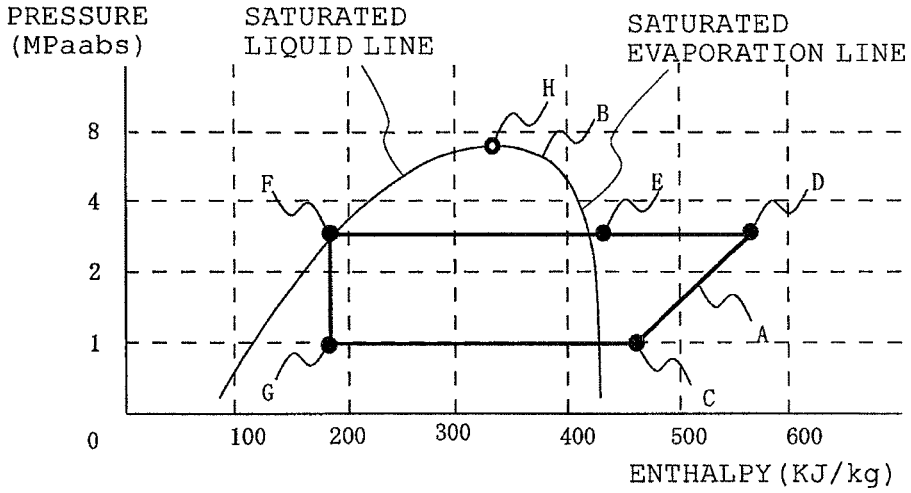
FIG. 2 is a Mollier diagram showing a cooling operation of a low temperature side cycle in Embodiment 1.

FIG. 2 is a Mollier diagram (P—H diagram) showing the state of the low temperature side refrigerant during the cooling operation. FIG. 2 shows that the vertical axis indicates an absolute pressure (MPaabs) and the horizontal axis indicates a specific enthalpy (KJ/kg). In FIG. 2, an area surrounded by curve B (that is, a line formed by a saturated liquid line and a saturated evaporation line) indicates that the low temperature side refrigerant is in a two-phase gas-liquid state. Further, an area at the left side of the saturated liquid line indicates that the low temperature side refrigerant is in a liquid state and an area at a right side of the saturated liquid line indicates that the low temperature refrigerant is in a gas state.

Further, in FIG. 2, the top H of curve B is called a critical point, and an area above the critical point has no change of liquid phase and vapor phase. Line A represented by a substantially trapezoidal form in FIG. 2 indicates variations and the like in the state of a refrigerant in the operations (processes) to be performed by various units during the cooling operation of the low temperature side cycle 20. The low temperature side cycle 20 forms a low temperature side circulation circuit and therefore, it is formed as a closed path. The details of the low temperature side cycle 20 are described below.

Next, the operation of the low temperature side cycle 20 during the cooling operation is described with reference to FIG. 1 and FIG. 2. The low temperature side compressor 21 sucks in a low temperature side refrigerant and compresses the refrigerant and further discharges it into a high temperature and high pressure state (refer to a compression process from point C to point D in FIG. 2). The discharged refrigerant flows into the low temperature side first condenser 22A (first cascade condenser 30A). At this time, for example, the temperature of the sucked gas refrigerant at point C is about 0 degrees C., and the temperature of the discharged gas refrigerant at point D is about 120 degrees C.

The low temperature side first condenser 22A exchanges heat between a low temperature side refrigerant and a high temperature side refrigerant circulating in the high temperature side first evaporator 14A (refer to a condensation process from point D to point E shown in FIG. 2). As described above, it is not necessary to condense and liquefy the low temperature side refrigerant, and the low temperature side refrigerant may also be cooled down to a fixed temperature. In this case, for example, the evaporation temperature in the high temperature side first condenser 12A is 10 degrees C., and the temperature of the low temperature side refrigerant at point E is about 15 degrees C.

The refrigerant flowing out from the low temperature side first condenser 22A flows into the low temperature side second condenser 22B (second cascade condenser 30B). The low temperature side second condenser 22B exchanges heat with a high temperature side refrigerant circulating in the high temperature side second evaporator 24B, so as to condense and liquefy the low temperature side refrigerant (refer to a condensation process from point E to point F in FIG. 2). In this case, for example, the evaporation temperature in the high temperature side second condenser 12B is −10 degrees C., and the temperature of the low temperature side refrigerant at point F becomes about −5 degrees C.

The condensed and liquefied low temperature side refrigerant passes through the low temperature side expansion unit 23. The low temperature side expansion unit 23 depressurizes the condensed and liquefied low temperature side refrigerant (refer to an expansion process from point F to point G in FIG. 2). In this case, for example, the temperature of the low temperature side refrigerant at point G is about −40 degrees C. The depressurized low temperature side refrigerant flows into the low temperature side evaporator 24. The low temperature side evaporator 24 exchanges heat between an object to be cooled and the low temperature side refrigerant, so as to evaporate and gasify the low temperature side refrigerant. Then, the low temperature side refrigerant flowing out from the low temperature side evaporator 24 is sucked into the low temperature side compressor 21 (refer to an evaporation process from point G to point C in FIG. 2). The object to be cooled is directly or indirectly cooled. In this case, the control unit 40 makes the low temperature side expansion unit 23 to perform adjustment the opening degree so that the low temperature side refrigerant flowing out from the low temperature side evaporator 24 has a required degree of superheat (4 to 10K).

Here, the above-described TEWI can be calculated by the following expression (1). The parameters in the expression (1) are described below. That is, TEWI represents Total Equivalent Warming Impact ($kgCO_2$), GWP represents Global Warming Potential, m represents the amount of refrigerant charged in a refrigerant circulation circuit (kg), L represents the annual refrigerant leakage ratio (%), n represents years of operation of units, α represents the recovery rate of refrigerant at the time of being discarded, W represents the annual consumed electric power (kWh/year), and β represents a $CO_2$ emission unit consumption of electric power.

$$TEWI=GWP\times m\times L\times n+GWP\times m\times(1-\alpha)+n\times W\times\beta \quad (1)$$

In order to lessen the value of TEWI from the above-described expression (1), the amount of refrigerant charged is reduced using a refrigerant having a small GWP, which leads to reduction of the annual consumed electric power. In the present embodiment, two cascade condensers 30 (low temperature side condensers 22) are provided, and the low temperature side refrigerant is thereby condensed and liquefied by stages. In this case, by setting the respective evaporation temperatures in the high temperature side evaporators 14 at different temperatures and using a high temperature side refrigerant in conformity to each of the different evaporation temperatures, a highly efficient cooling operation is carried out and it is possible to consume lower amounts of power. Then, by performing different controls with the evaporation temperatures or the like in the respective high temperature side evaporators 14 of the plural high temperature side cycles 10, a high temperature side refrigerant used in each of the high temperature side cycles 10 can become wider to be selected. Then, due to the efficient operation, the amount of the low temperature side refrigerant charged in the low temperature side cycle 20 also can be reduced. In such a manner as described above, not only refrigeration cycle unit, but TEWI can be reduced as a whole.

As described above, the refrigerating apparatus of Embodiment 1 is adapted to condense and liquefy the low temperature side refrigerant circulating in the low temperature side cycle 20 using the high temperature side first cycle 10A and the high temperature side second cycle 10B, and also reduce the amount of a high temperature side refrigerant circulating in each of the high temperature side first cycle 10A and the high temperature side second cycle 10B. As a result, for example, even when a hydrocarbon-based refrigerant, or a combustible refrigerant such as HFO01234yf or R32 is used, the amount of refrigerant in one refrigeration cycle can be reduced, and it is possible to reduce costs required for safety measures in the unlikely event that a refrigerant may leak out of the refrigeration cycle.

Further, even in a case in which a chlorofluorocarbon refrigerant (for example, R410A or the like) having incombustibility and a relatively low GWP is used, the amount of refrigerant charged in one refrigerant circulation circuit can be lowered, and therefore, the costs required for environmental protection on the assumption that a high temperature side refrigerant may leak out of the refrigerant circulation circuit can be reduced.

Moreover, by performing the cooling operation in such a manner that the evaporation temperature of the high temperature side first evaporator 14A is set to be higher than the evaporation temperature of the high temperature side second evaporator 14B, a refrigerant can be gradually cooled, and condensed and liquefied on the basis of the flow of the low temperature side refrigerant, and therefore, the operating efficiency can be enhanced. As a result, TEWI can be reduced and contributions to prevention of global warming can be achieved coincidentally.

In this case, each of high temperature side refrigerants is adapted to be charged so that the boiling point of a high temperature side refrigerant circulating in the high temperature side first cycle 10A becomes higher than the boiling point of a high temperature side refrigerant circulating in the high temperature side second cycle 10B, and therefore, an operation suitable for each of the evaporation temperatures can be carried out and the operating efficiency can be further enhanced. As a result, the value of TEWI (Total Equivalent Warming Impact) can be further reduced, and contributions to prevention of global warming can be achieved coincidentally. Here, in Embodiment 1, two high temperature side cycles, that is, the high temperature side first cycle 10A and the high temperature side second cycle 10B, are shown as an example, but even when, for example, three or more high temperature side circulation circuits are provided, at least the similar effect can be obtained.

Figure 3:
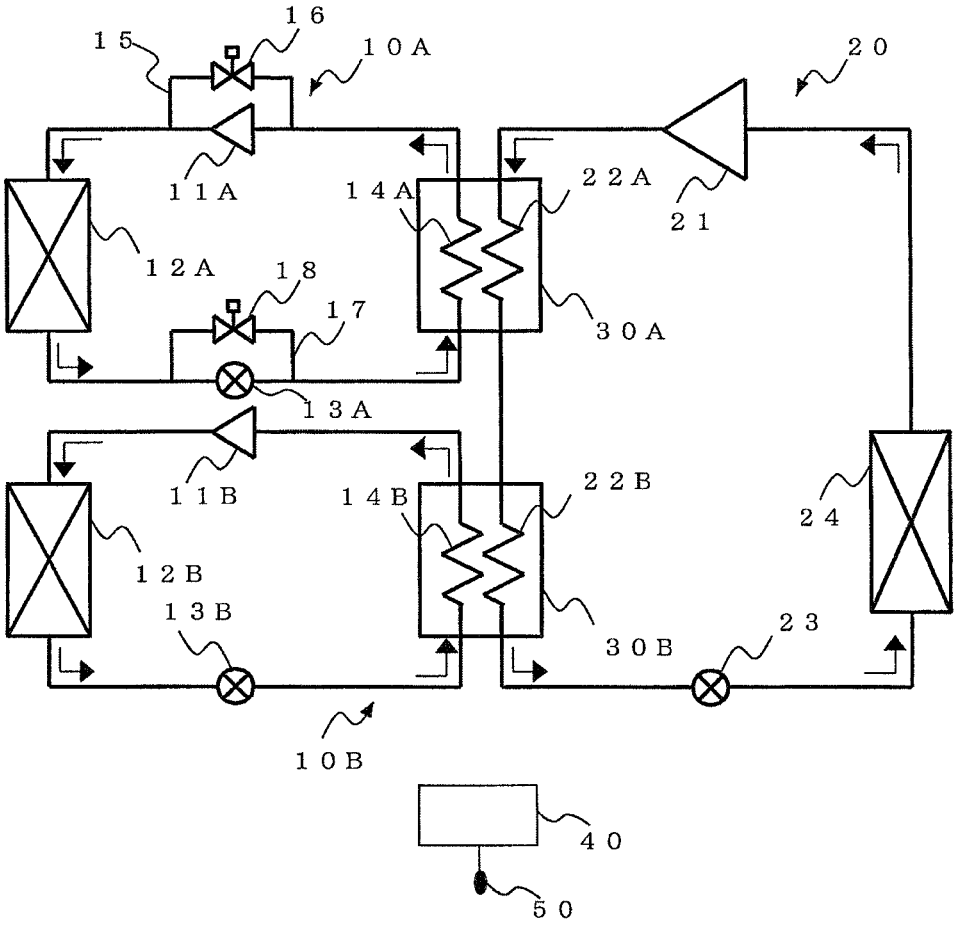
FIG. 3 is a diagram showing a structure of a refrigerating apparatus in Embodiment 2 of the present invention.

Embodiment 2:

FIG. 3 is a diagram showing the structure of a refrigeration circuit according to Embodiment 2 of the present invention. Note that the units and the like to which the same reference numerals as those of FIG. 1 are applied each should carry out the same operation as described in Embodiment 1 or the like. In a cascade refrigerating apparatus according to the present embodiment, as shown in FIG. 3, the high temperature side first cycle 10A is configured in such a manner that a high temperature side first compressor bypass pipe 15 used to prevent a high temperature side refrigerant from passing through the high temperature side first compressor 11A is connected by a pipe in parallel with the high temperature side first compressor 11A. The high temperature side first compressor bypass pipe 15 is provided with a compressor bypass on-off valve 16 used to control passing of the high temperature side refrigerant. Further, a high temperature side first expansion unit bypass pipe 17 used to prevent a high temperature side refrigerant from passing through the high temperature side first expansion unit 13A is connected by a pipe in parallel with the high temperature side first expansion unit 13A. The high temperature side first expansion unit bypass pipe 17 is also provided with an expansion unit bypass on-off valve 18. In this case, passing control in the bypass pipe is carried out by use of the on-off valve, but the on-off valve may also be formed by a unit such as a flow adjusting valve or the like.

Further, an outside air temperature sensor 50 is a temperature detecting unit that detects the temperature of outside air and transmits a signal of the detected temperature to the control unit 40.

For example, as described in Embodiment 1, in order that the temperature of the low temperature side refrigerant at point E in FIG. 2 may be set at 15 degrees C., the evaporation temperature in the high temperature side first evaporator 14A of the high temperature side first cycle 10A is set at about 10 degrees C. For this reason, there are cases that for example, air temperature, water temperature and the like may be seasonally lower than the evaporation temperature. In such cases, a natural circulation operation for naturally circulating a refrigerant in the high temperature side first cycle 10A can be carried out without driving the high temperature side first compressor 11A.

Consequently, when the outside air temperature is lower than the evaporation temperature, in the present embodiment, a natural circulation operation is carried out in such a manner that the high temperature side refrigerant is made to pass through the high temperature side first compressor bypass pipe 15 and the high temperature side first expansion unit bypass pipe 17, and further, energy saving is achieved. Here, the present embodiment is described on the assumption that the high temperature side first cycle 10A is capable of performing the natural circulation operation. However, depending on a temperature range in which the refrigerating apparatus performs cooling or the like, a target evaporation temperature of the high temperature side second evaporator 14B, and the like, the high temperature side second cycle 10B may also be configured so as to be capable of performing the natural circulation operation.

Figure 4:
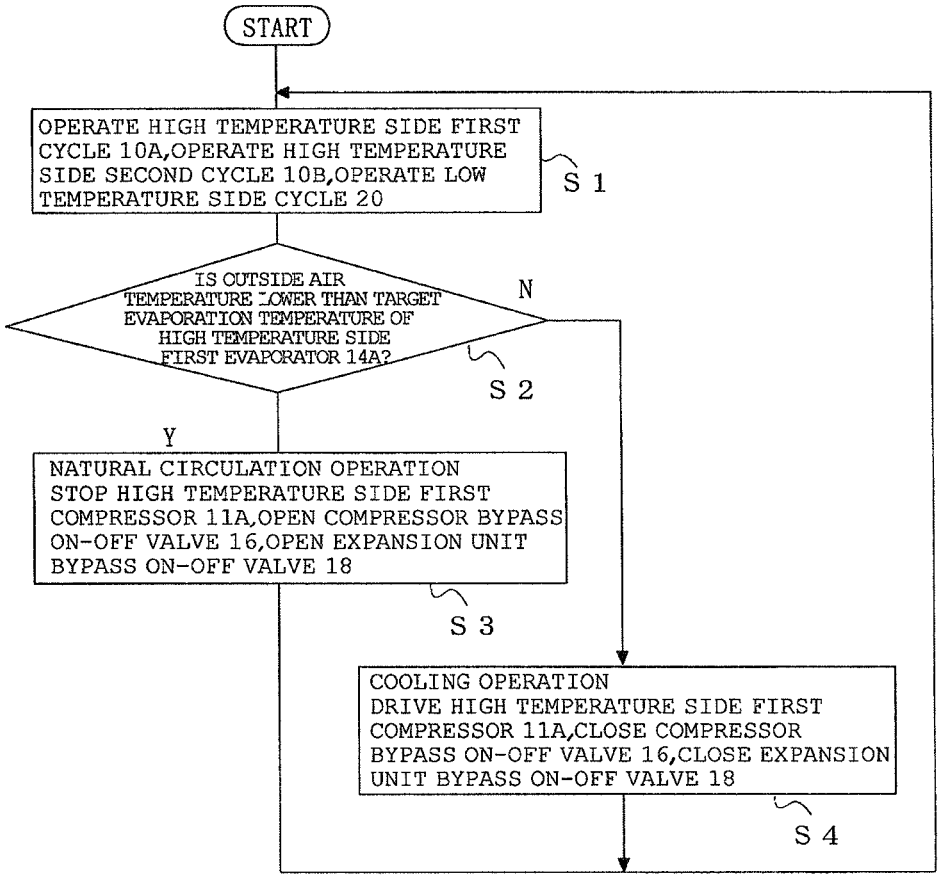
FIG. 4 is a diagram showing an operation control flow chart in Embodiment 2.

FIG. 4 is a flow chart of an operation control of the refrigerating apparatus according to Embodiment 2. Note that the operation control is carried out by the control unit 40 in the same manner as in Embodiment 1. As shown in FIG. 4, the control unit 40 makes the high temperature side first cycle 10A, the high temperature side second cycle 10B and the low temperature side cycle 20 to perform a cooling operation (S1). The operations and the like of various units in the cooling operation are similar to those described in Embodiment 1. At this moment, the compressor bypass on-off valve 16 and the expansion unit bypass on-off valve 18 are closed.

The control unit 40 determines whether the outside air temperature is lower than the evaporation temperature on the basis of a signal from the outside air temperature sensor 50 (S2). When it is determined that the outside air temperature is lower than the evaporation temperature, the control unit 40 controls the high temperature side first cycle 10A to perform the natural circulation operation (S3), and the process returns to S1. At this moment, in the high temperature side first cycle 10A, driving of the high temperature side first compressor 11A is stopped. Then, the compressor bypass on-off valve 16 and the expansion unit bypass on-off valve 18 are opened, so as to make the high temperature side refrigerant to pass through the high temperature side first compressor bypass pipe 5 and the high temperature side first expansion unit bypass pipe 17.

An air sending device (not shown) which sends air or the like to the high temperature side first condenser 12A is adapted to continue driving and facilitate cooling of the high temperature side refrigerant. The air sending device may be, for example, controlled so as to drive at the maximum (at flunk speed).

In S2, it is determined whether the outside air temperature is the evaporation temperature or higher. When it is determined that the outside air temperature is the evaporation temperature or higher, the control unit 40 controls so as to perform a cooling operation (S4) and the process returns to S1. At this moment, in the high temperature side first cycle 10A, the high temperature side first compressor 11A is driven. Then, the compressor bypass on-off valve 16 and the expansion unit bypass on-off valve 18 are closed, so as to prevent the high temperature side refrigerant from passing through the high temperature side first compressor bypass pipe 15 and the high temperature side first expansion bypass pipe 17.

Although not particularly specified here, after control is switched between the cooling operation and the natural circulation operation, control may be made so as not to switch between the cooling operation and the natural circulation operation until a predetermined time elapses.

As described above, the refrigerating apparatus of Embodiment 2 is configured in such a manner that, in addition to the effects described in Embodiment 1, when the evaporation temperature of the high temperature side first evaporator 14A is lower than the outside air temperature in the high temperature side first cycle 10A, the high temperature side first compressor 11A is stopped and the natural circulation operation is carried out by making the high temperature side refrigerant to pass through the high temperature side first compressor bypass pipe 15 and the high temperature side first expansion device bypass pipe 17, thereby making it possible to achieve energy saving.

In this case, the temperature of the low temperature side refrigerant at point E shown in FIG. 2 is set at 15 degrees C. in conformity to the operation of Embodiment 1, but by setting the temperature at, for example, 20 degrees C. or thereabouts, control may be made so that the evaporation temperature of the high temperature side refrigerant in the high temperature side first evaporator 14A becomes high. When the evaporation temperature becomes high, the ratio of the time for which the natural circulation operation is carried out becomes larger and the operating efficiency further becomes better, whereby achievement of energy saving can be anticipated.

Industrial Applicability

The above-described embodiment is constructed in such a manner that the high temperature side first cycle 10A and the high temperature side second cycle 10B are connected to the low temperature side cycle 20 by the first cascade condenser 30A and the second cascade condenser 30, respectively. However, the number of high temperature side cycles does not need to be limited to two. For example, three or more high temperature side cycles 10 can be connected to the low temperature side cycle 20 by three or more respective cascade condensers 30. Further, although explained in the section of the cascade refrigerating apparatus, the present invention also can be applied to a multidimensional refrigerating apparatus having a multi-stage structure.

REFERENCE SIGNS LIST

10A: high temperature side first cycle, 11A: high temperature side first compressor, 12A: high temperature side first condenser, 13A: high temperature side first expansion unit, 14A: high temperature side first evaporator, 10B: high temperature side second cycle, 11B: high temperature side second compressor, 12B: high temperature side second condenser, 13B: high temperature side second expansion unit, 14B: high temperature side second evaporator, 15: high temperature side first compressor bypass pipe, 16: compressor bypass on-off valve, 17: high temperature side first expansion unit bypass pipe, 18: expansion unit bypass on-off valve, 20: low temperature side cycle, 21: low temperature side compressor, 22A: low temperature side first condenser, 22B: low temperature side second condenser, 23: low temperature side expansion unit, 24: low temperature side evaporator, 25: low temperature side intermediate cooler, 30A: first cascade condenser, 30B: second cascade condenser, 40: control unit, 50: outside air temperature sensor.

The invention claimed is:

1. A refrigerating apparatus comprising:

a plurality of high temperature side cycle units each forming a high temperature side circulation circuit in which a high temperature side compressor, a high temperature side condenser, a high temperature side expansion unit and a high temperature side evaporator are connected by first pipes to circulate a high temperature side refrigerant;

a low temperature side cycle unit forming a low temperature side circulation circuit in which a low temperature side compressor, a plurality of low temperature side condensers, a low temperature side expansion unit and a low temperature side evaporator are connected by second pipes to circulate carbon dioxide as a low temperature side refrigerant;

a plurality of cascade condensers formed by the respective high temperature side evaporators of the plurality of high temperature side cycle units, and the respective low temperature side condensers, and each exchanging heat between the high temperature side refrigerant and the low temperature side refrigerant; and a control unit controlling so as to sequentially lower evaporation temperatures in the high temperature side evaporators related to the respective low temperature side condensers in the cascade condensers in such order that the low temperature side refrigerant flows in and out from the low temperature side condensers, wherein, in at least a part of the high temperature side cycle units, bypass pipes are connected in parallel with the high temperature side compressor and the high temperature side expansion unit, respectively, and the control unit configured to control evaporation temperatures in the respective high temperature side evaporators of the high temperature side cycle units to be different from each other, with respect to each high temperature side cycle unit which has the bypass pipes, which has the evaporation temperature which is controlled to be different from the evaporation temperature of another one of the high temperature side evaporators of another one of the high temperature side cycle units, the control unit:

determines, periodically, whether an evaporation temperature in the high temperature side evaporator is higher than an outside air temperature, when the evaporation temperature in the high temperature side evaporator of the high temperature side cycle unit is determined to be higher than the outside air temperature, the control unit performs operations of stopping the high temperature side compressor of the high temperature side cycle unit, and circulating the high temperature side refrigerant by passing the high temperature side refrigerant through the bypass pipes of the high temperature side cycle unit, and when the evaporation temperature in the high temperature side evaporator of the high temperature side cycle unit is determined to not be higher than the outside air temperature, the control unit performs operations of starting the high temperature side compressor of the high temperature side cycle unit, and circulating the high temperature side refrigerant with the bypass pipes of the high temperature side cycle unit closed.

2. The refrigerating apparatus of claim 1, wherein the high temperature side refrigerant whose boiling point corresponds to the level of the evaporation temperature of the high temperature side evaporator is charged.

3. The refrigerating apparatus of claim 1, wherein the high temperature side refrigerant to be charged in one or more high temperature side cycle units among the plurality of high temperature side cycle units is tetrafluoropropene.

4. The refrigerating apparatus of claim 2, wherein the high temperature side refrigerant to be charged in one or more high temperature side cycle units among the plurality of high temperature side cycle units is tetrafluoropropene.

5. The refrigerating apparatus of claim 1, wherein the plurality of cascade condensers include a first cascade condenser and a second cascade condenser that form a two-stage structure each formed by the respective high temperature side evaporator of the plurality of high temperature side cycle units, and the respective low temperature side condenser.

6. The refrigerating apparatus of claim 2, wherein the plurality of cascade condensers include a first cascade condenser and a second cascade condenser that form a two-stage structure each formed by the respective high temperature side evaporator of the plurality of high temperature side cycle units, and the respective low temperature side condenser.

7. The refrigerating apparatus of claim 4, wherein the plurality of cascade condensers include a first cascade condenser and a second cascade condenser that form a two-stage structure each formed by the respective high temperature side evaporator of the plurality of high temperature side cycle units, and the respective low temperature side condenser.

8. The refrigerating apparatus of claim 1, wherein in the high temperature side circulation circuit, at least one of the high temperature side cycle units which has the bypass pipes is upstream, with respect to a direction of flow of the low temperature side refrigerant in and out from the low temperature side condensers, of another one of the high temperature side cycle units.

9. The refrigerating apparatus of claim 2, wherein in the high temperature side circulation circuit, at least one of the high temperature side cycle units which has the bypass pipes is upstream, with respect to a direction of flow of the low temperature side refrigerant in and out from the low temperature side condensers, of another one of the high temperature side cycle units.

10. The refrigerating apparatus of claim 4, wherein in the high temperature side circulation circuit, at least one of the high temperature side cycle units which has the bypass pipes is upstream, with respect to a direction of flow of the low temperature side refrigerant in and out from the low temperature side condensers, of another one of the high temperature side cycle units.

11. The refrigerating apparatus of claim 5, wherein in the high temperature side circulation circuit, at least one of the high temperature side cycle units which has the bypass pipes is upstream, with respect to a direction of flow of the low temperature side refrigerant in and out from the low temperature side condensers, of another one of the high temperature side cycle units.

* * * * *